United States Patent [19]

Borowski et al.

[11] 4,212,497

[45] Jul. 15, 1980

[54] LIQUID DISCHARGE APPARATUS FOR A SHEARING-LOADER TYPE MINING MACHINE

[75] Inventors: Karl-Heinz Borowski; Heinrich Honke, both of Bochum, Fed. Rep. of Germany

[73] Assignee: Gebr. Eickhoff Maschinenfabrik und Eisengiesserei mbH, Bochum, Fed. Rep. of Germany

[21] Appl. No.: 15,501

[22] Filed: Feb. 26, 1979

[30] Foreign Application Priority Data

Mar. 2, 1978 [DE] Fed. Rep. of Germany ..... 2808915

[51] Int. Cl.[2] ..... E21C 35/22

[52] U.S. Cl. ..... 299/53; 299/81

[58] Field of Search ..... 299/12, 43, 52–54, 299/81

[56] References Cited

U.S. PATENT DOCUMENTS

| | | | |
|---|---|---|---|
| 1,473,498 | 11/1923 | Morgan | 299/81 |
| 3,374,033 | 3/1968 | Arentzen | 299/81 |
| 3,698,769 | 10/1972 | Amoroso | 299/81 |
| 4,049,318 | 9/1977 | Fruin | 299/81 |

FOREIGN PATENT DOCUMENTS

| | | | |
|---|---|---|---|
| 1110763 | 4/1968 | United Kingdom | 299/81 |

*Primary Examiner*—Ernest R. Purser

*Attorney, Agent, or Firm*—Thomas H. Murray; Clifford A. Poff

[57] ABSTRACT

A shearing drum of a shearing-loader type mining machine includes nozzles distributed about the periphery thereof for the delivery of high-pressure liquid from only an arcuate segment of the drum while directed for working a mine face. Conduit members extend radially in the shear drum to communicate with nozzle members. A shaft or tube about which the shearing drum rotates has at least one internal opening to conduct liquid in a direction generally parallel to the rotational axis of the shearing drum. The shaft or tube includes a valve formed by one or diametrically-opposite valve recesses at the longitudinal center within the periphery thereof. The size and configuration of the valve recess are selected to correspond to the period of time for which liquid is discharged from the individual nozzles. Liquid passed from the valve recess is delivered by radial conduit lines formed in a member that rotates with the shear drum while in sealed communication with the valve recess. The shaft or tube may be rotated by a drive such as a linear or rotary motor or a crank drive which includes a disc coupled to the shaft or tube for rotary movement thereof by bars or chains which are arranged parallel and connected to diametrically-opposite points on the disc and extend to the machinery unit where they are anchored by pivot pins.

9 Claims, 9 Drawing Figures

LIQUID DISCHARGE APPARATUS FOR A SHEARING-LOADER TYPE MINING MACHINE

BACKGROUND OF THE INVENTION

This invention relates to a shearing-loader type mining machine wherein a shearing drum includes nozzles distributed about the periphery thereof for delivering a high-pressure liquid from a supply line in a drum shaft through a valve to only the nozzles opposite the mine face being worked. More particularly, according to the present invention the valve takes the form of a recess communicating with the liquid line in the drum shaft which does not rotate with the shearing drum but disposed within the hub thereof such that the recess extends in the peripheral direction of the drum over an angle corresponding to the nozzle supply zone. The invention is further characterized by arranging a member to cover the valve recess in a liquid-tight manner within the hub of the shearing drum so that the member rotates therewith.

In British Pat. No. 1,110,763, there is disclosed a shearing drum having nozzles distributed about the periphery thereof adjacent cutter picks. Each nozzle is connected by radially-extending lines to a liquid conducting tube which extends through the shearing drum drive shaft. The tube is non-rotatably disposed in a central bore of the shearing drum drive shaft mounted on roller bearings for rotation. The tube extends over the entire length of the drive shaft and projects from the end face of the drive shaft. A projected end of the tube is coupled to a disc for rotation within a chamber formed by an annular plate connected to a drive shaft. The chamber is further formed by a cover with a recess to receive the disc. The annular plate rotates with the shearing drum. A peripheral recess in the disc extends over particular regions while in permanent communication with the liquid feed tube. The peripheral recess communicates with radial grooves in the cover of the chamber only when the grooves pass the peripheral recesses due to rotation of the drum. In this way there is communication between the interior of the tube and the radial lines associated with a particular groove to feed liquid to one of the nozzles as the groove passes the peripheral recess. The nozzles are supplied with water only during the short period of time while the grooves are in communication with the peripheral recesses in the disc. The communication occurs when a nozzle is near the part of the mineral face due to the position of the recess.

SUMMARY OF THE INVENTION

It is an object of the present invention to provide an improved construction and arrangement of parts for controlling the supply of liquid for discharge from nozzles on the shearing drum of a mining machine.

In accordance with the present invention, there is provided in a mining machine having drive means for propelling the mining machine along a course of travel at a mine face, the mining machine including a machinery unit, a pivotal support arm carrying a rotatably-driven shearing drum, the combination therewith of apparatus to discharge liquid from only an arcuate face segment of the shearing drum while directed toward a mine face, the apparatus including liquid discharge nozzle members circumferentially distributed about the periphery of the shearing drum, conduit members extending radially in the shearing drum to communicate with the circumferentially-spaced nozzle members, shaft means about which the shearing drum independently rotates, the shaft means having at least one internal opening to conduct fluid in a direction generally parallel to the rotational axis of the shearing drum, the shaft means including a valve having a valve recess substantially at the longitudinal center within the periphery of the shaft means for communicating with the internal opening thereof, the valve recess extending about the peripheral surface of the shaft means through an angle selected to correspond to at least part of the arcuate face of the shearing drum while directed toward the working face of the mine, and means rotatable with the shearing drum in sealed communication with the valve of the shaft means to control the period while individual conduit members deliver liquid passed through the valve to the nozzle members.

Thus, according to the present invention, in a mining machine of the type described, the valve recess is disposed substantially at the longitudinal center on the periphery of either the shaft which carries the shearing drum and does not rotate therewith or a non-rotating tube mounted centrally inside the shearing drum drive shaft. The valve recess is covered either by hub means of the shearing drum which extends sealingly around the drive shaft or by the shearing drum drive shaft which extends sealingly around the non-rotating tube. By this construction, either the shearing drum hub means or its drive shaft controls the period during which each nozzle is supplied with liquid by a radial line which communicates with the central bore of the hub or drive shaft. Consequently, the present invention brings about a considerable simplification to the apparatus for the supply of liquid to nozzles adjacent the mineral face and a considerable reduction to the expenditure previously necessary to control the supply of liquid with an improvement to the reliability of operation of the control. Also, the shearing drum, which is particularly well suited for the supply of high-pressure liquid to the nozzles, is free of liquid pressure in an axial direction since the forces produced by the liquid under pressure are substantially only radial and not an external force.

To achieve a very-tightly sealed closure for the liquid control of a high-pressure liquid in the shearing drum, the radial lines extending to the nozzles or nozzle groups join the bore in the shearing drum drive shaft within a common plane perpendicular to the axis of rotation of the shearing drum. This arrangement provides relatively large sealing surfaces at either side of the common plane containing the junction with the radial lines, thus insuring a satisfactory closure and separation of the liquid system even at high pressure.

Alternatively, in the mining machine of the present invention as described hereinbefore, each radial line joining the bore in the hub of the shearing drum or the bore in the shearing drum drive shaft is disposed in its own plane perpendicular to the axis of the shearing drum rotation. The valve recess in the shaft or tube has a shape, width and/or length which varies axially according to the period for which it is required to supply liquid to the various nozzles or nozzle groups. In instances where a shaped recess is used, for example, a trapezoidally-shaped valve recess, the width of the recess varies over its length and also in the instance where a constant-width valve recess is inclined to the drum shaft or extends helically, a width of the valve recess, within the plane of rotation of the radial lines extending to the nozzles, determines the duration and instants of the time during which the various nozzles are supplied with liquid. Consequently, by employing an appropriately-shaped valve recess, it is possible for the nozzles directed toward the mineral face to be supplied with liquid for different lengths of time and for particular time differences.

Moreover, according to another feature of the present invention, the drum shaft or non-rotating tube is formed with a valve recess on each of two diametrically-opposite peripheral portions with each recess being associated either with an independent and individual liquid supply opening in the shaft or with an individual supply line in the tube. Consequently, when the mining machine undergoes a reverse direction of travel, that half of the periphery of the shearing drum which now leads in the direction of movement by the mining machine is supplied with pressurized liquid by the correspondingly-fed bore and the liquid supply to the nozzles is adapted to the position of the mineral face.

Alternatively, the shaft or tube can be rotatably mounted in order to correlate the supply region of the nozzles on the shearing drum with the position of the mineral face presented to the shearing drum. To this end, and adjusting drive adapted to rotate the shaft or tube is provided on the mining machine or the drum support arm thereof.

Conveniently, in the case of mining machines having shearing drums each mounted for vertical adjustment on a pivoted support arm, a disc is connected to the support shaft or rotatably-mounted tube at the side of the shearing drum which is adjacent the support arm. Two parallel bars or chains engage the disc at oppositely-disposed points on the periphery thereof. The bars or chains are mounted at their other ends by pivot pins to the machinery unit whereby the bars or chains form a parallel crank drive through the interconnection formed thereby. The employment of this feature insures that when the support arm pivots, the supply region of the nozzles is adapted automatically to the position of that part of the mineral face which is presented to the shearing drum.

These features and advantages of the present invention as well as others will be more fully understood when the following description is read in light of the accompanying drawings, in which.

Figure 1:
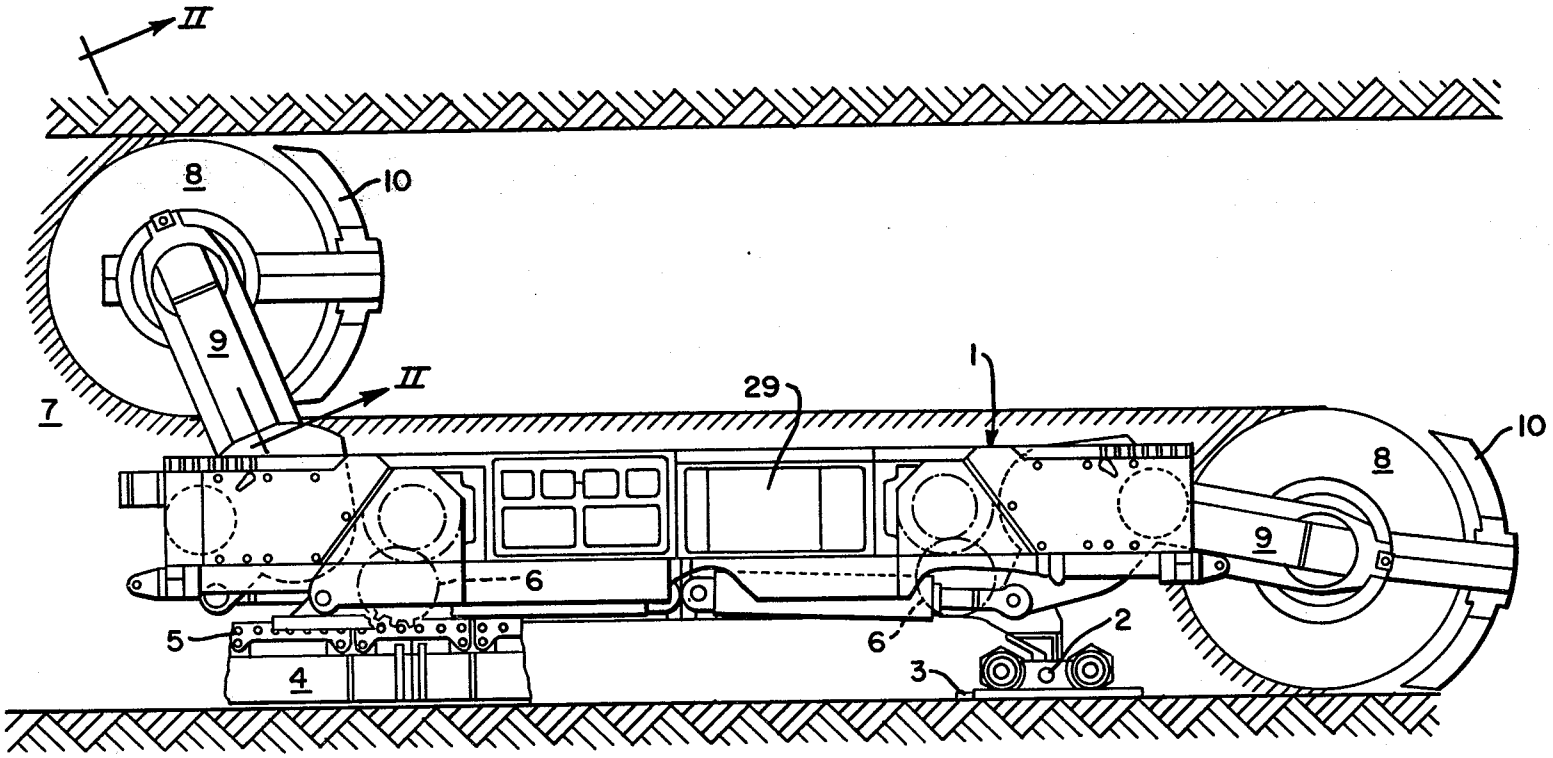
FIG. 1 is a side elevational view of a shearing-loader type mining machine embodying the features of the present invention.

In FIG. 1, there is illustrated a shearing-loader type mining machine 1 which includes a machinery unit disposed above a face conveyor, not shown. On the face side of the mining machine, roller-fitted skids or runners 2 rest on a face ramp 3. At the stow side, the machine 1 has plain skids or runners that bear on a toothed rack 5 made up of individual sections mounted on a side member 4. The mining machine 1 is propelled along the mineral face 7 by a drive which includes two driving wheels 6 engaged in the teeth of rack 5. The mining machine further includes two shearing drums 8 mounted on support arm 9 for vertical adjustment at the opposite ends of the mining machine for working the mine seam. A clearing plate 10 pivots around each shearing drum shaft to cover part of the periphery of the shearing drum which is remote from the face 7. The part of the mine face 7 which faces the shearing drum is loosened by means of cutter picks, not shown, disposed on the periphery of the drum. The resulting debris is discharged laterally to the face conveyor by means of helical conveyor elements, not shown.

Figure 2:
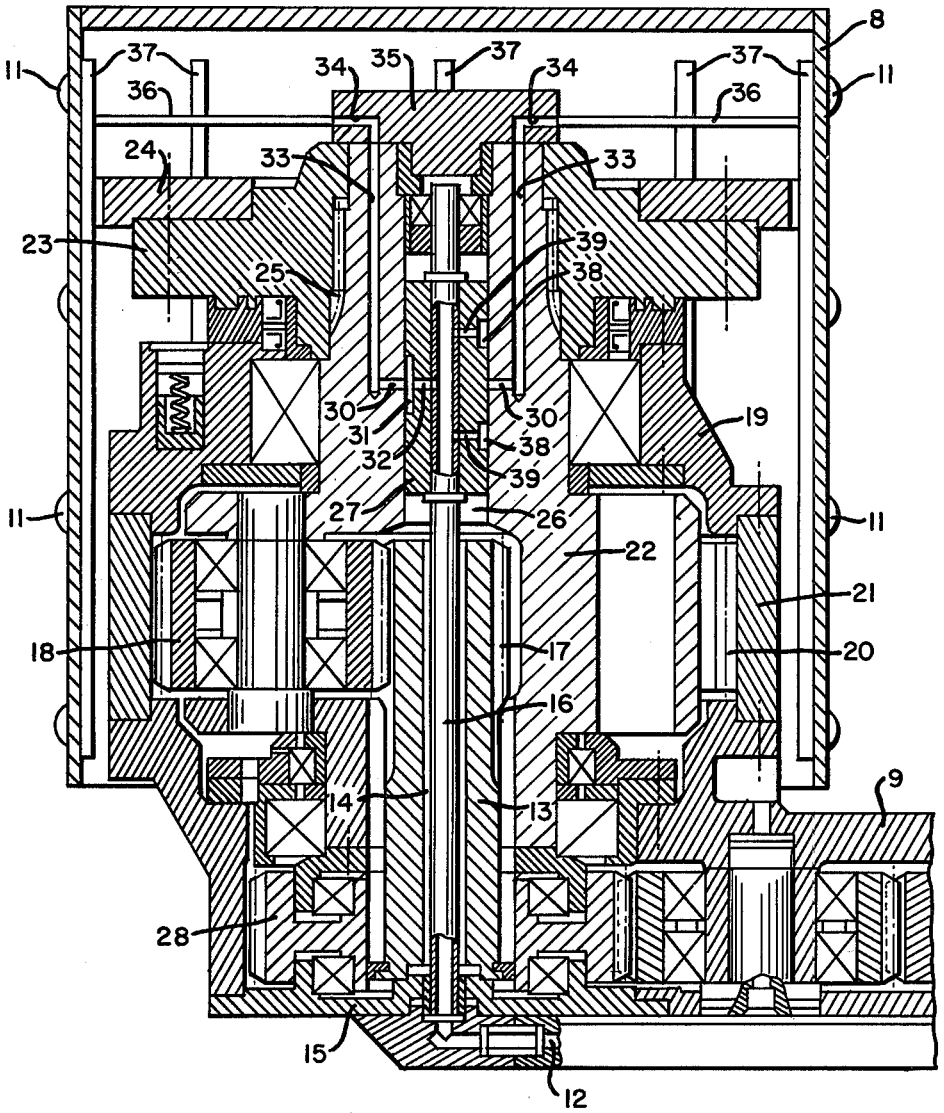
FIG. 2 is a sectional view taken along line II—II of FIG. 1.

As illustrated in FIG. 2, nozzles 11 are circumferentially distributed about the periphery of the shearing drum 8. Liquid is sprayed or otherwise discharged from the nozzles to suppress dust or, in the case of discharge of liquid under high pressure, to boost the work of the cutter picks. It is to be understood, of course, that in addition to nozzles 11, the helical conveyors and cutter picks supported in pick boxes are carried on the periphery of each shearing drum. The discharge of liquid should always be limited to that region of the periphery of the drum which is nearer, as considered in the direction of machine movement, the working face zone presented in front of a particular shearing drum 8. Both shearing drums must, therefore, have a control to insure that only the nozzles momentarily adjacent the mine face are supplied with liquid.

In FIG. 2, the support arm 9 has a liquid-feed line 12 that communicates with a tube 16 extending in a bore 14 through a drive shaft 13. The tube 16 is non-rotatably retained by a cover 15 on arm 9. Drive shaft 13 has gear teeth 17 to transmit rotation thereof to satellite gears 18 of a planetary reduction gear 19 disposed in the shell of the shearing drum. The satellites 19 have gear teeth meshing with internal gear teeth 20 in a sleeve 21 which is rigidly secured to the arm 9 so that as the satellites 18 rotate about shaft 13, a satellite carrier 22 is driven. The rotation of carrier 22 is transmitted to shearing drum 8 by a disc 23 that is fastened by bolts or the like to a web 24 within the drum 8. Gear teeth 25 form a drive connection between disc 23 and carrier 22.

Carrier 22 has a bore 26 into which tube 16 extends with the extended end thereof rigidly connected to a control sleeve 27 which, like tube 16, does not rotate with the shearing drum. Shaft 13 is coupled with a pinion 28 located within arm 9 and forms one member of a gear train disposed in the interior of the arm 9. The gear train transmits driving torque from the drive motor 29 on the machine 1 to the drum 8.

A peripheral recess 31 in control sleeve 27 remains stationary since sleeve 27 is rigidly disposed on tube 16 and always retains its position as the shearing drum rotates thereabout. Radial conduit lines 30 extend radially of the shearing drum 8 from the periphery of bore 26 in carrier 22. The control sleeve 27 is fitted closely in bore 26 so that radial lines 30 have brief communication with a valve recess 31 in the periphery of sleeve 27 as drum 8 rotates. Pressurized liquid flows from tube 16 through a radial bore 32 to valve recess 31 and thence into the radial lines 30 as determined by the position thereof and only during the relatively short period of time given by the peripheral extend of recess 31. Each radial line 30 communicates with a bore 33 extending in an axial direction in carrier 22. Pressurized fluid from the axial bores 33 is delivered to corresponding bores 34 in disc 35. The bores 34 communicate with radial lines 36 extending to tubes 37 secured onto the inside surface of shearing drum 8. Liquid is discharged from tubes 37 to nozzles 11 which, at the instant of discharge, are immediately adjacent the working face 7. The valve recess 31 extends over an angle in the direction of the drum periphery such that the angle includes that portion of the shearing drum periphery which is near the mine face 7 so that only those nozzles 11 which are momentarily opposite the face 7 receive liquid while there is a temporary cessation of the supply to all other nozzles 11 on the drum because the radial lines 30 thereof do not communicate with valve recess 31.

Recesses 38 are disposed on the distal peripheral side of sleeve 27 which is generally opposite the location of valve recess 31. Recesses 38 communicate with the interior of tube 16 by radial lines 39. Recesses 38 serve merely as pressure buffers to equalize radial loading on the sleeve 27 developed by the liquid pressure emanating from valve recess 31. The two recesses 38 should, therefore, have a width which is equal to one-half the width of valve recess 31 and disposed outside the plane of rotation of valve recess 31 so that there is no communication between lines 30 and recesses 38 as the carrier rotates.

Figure 3:
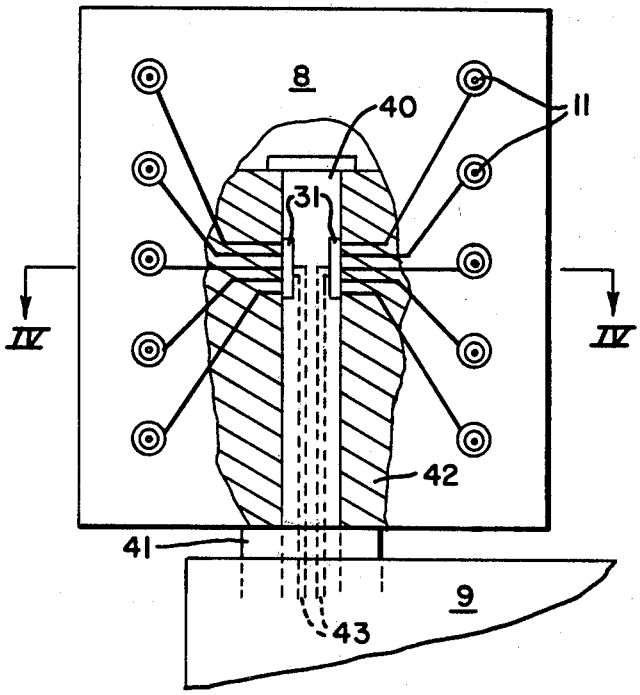
FIG. 3 is a diagrammatic view of a shearing drum, partly in section, to illustrate a second embodiment of the apparatus according to the present invention.
Figure 4:
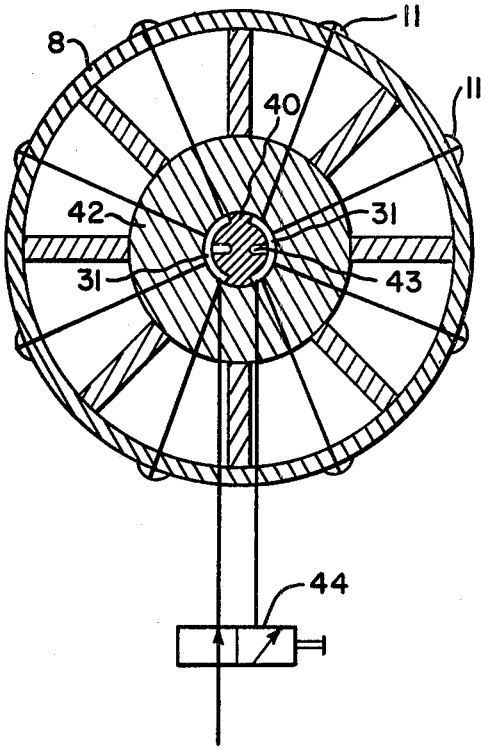
FIG. 4 is a sectional view taken along line IV—IV of FIG. 3.

However, according to the embodiment of the present invention shown in FIGS. 3 and 4, the shearing drum 8 is rotatably mounted on a shaft 40 of the machinery unit or the support arm 9. In this embodiment, the shearing drum 8 is drivingly connected by a face coupling sleeve 41 extending around the shaft 40 to reduction gearing, not shown, of the machinery unit or the gear train in arm 9. The shaft 40 has a peripheral recess 31 on each of two opposite peripheral sides thereof that are sealed in a liquid-tight manner within a drum hub 42. The recesses 31 may have different dimensions and different positions but each communicates with an axial bore 43 that, in turn, communicates with a liquid feed line on arm 9 or on the machinery unit. A two-way valve 44 is used to supply one or the other of the two bores 43 with liquid depending upon the direction in which the mining machine is propelled along the mine face for discharge from only those nozzles 11 directed toward the mine face.

Figure 5:
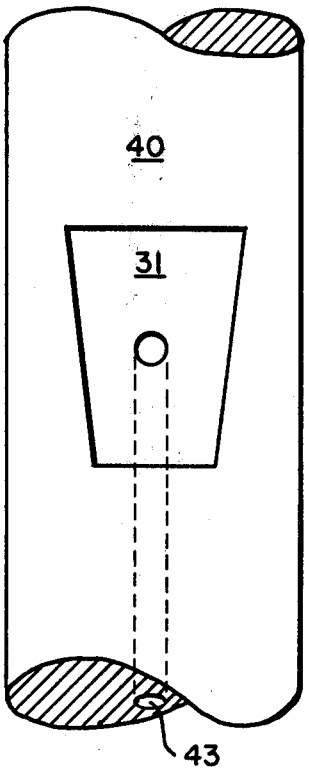
FIG. 5 is an enlarged view showing the details of one form of a valve recess to form part of the apparatus of the present invention.
Figure 6:
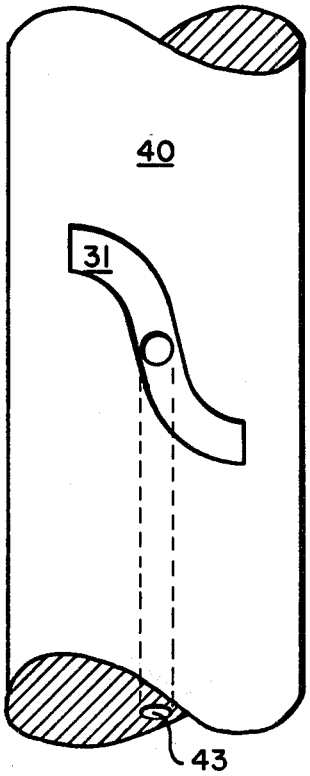
FIG. 6 is an enlarged view similar to FIG. 5 but illustrating a second form of the valve recess.

FIG. 5 illustrates a particular configuration for valve recess 31. The nozzles 11 which are simultaneously nearer the mine face 7 are supplied with liquid for different periods of time by providing that the recess 31 has a width which varies, e.g., increases, in an axial direction of the shearing drum 8. In this event, the nozzles near the bottom of the shearing drum are supplied with liquid for a longer period of time than the nozzles near the edges of the shearing drum. However, as shown, for example, in FIG. 6, the recess 31 may have an S-shaped configuration whereby additional liquid is supplied to the nozzles at both ends of the shearing drum and less liquid is supplied to the nozzles at the central part of the drum.

It is to be understood, of course, that sleeve 27 in the embodiment of FIG. 2, can be formed with oppositely-disposed peripheral recesses 31 and supplied alternatively with liquid under pressure through separate supply lines. Moreover, as in the embodiment shown in FIGS. 3 and 4, there should be recesses which are disposed on the peripheral side of shaft 40 opposite each recess 31, i.e., outside the plane of rotation of the radial bores in the drum hub 42, and which communicate with the axial bore 43 of the opposite recess and thus compensates for radial stresses produced by the liquid pressure.

Figure 7:
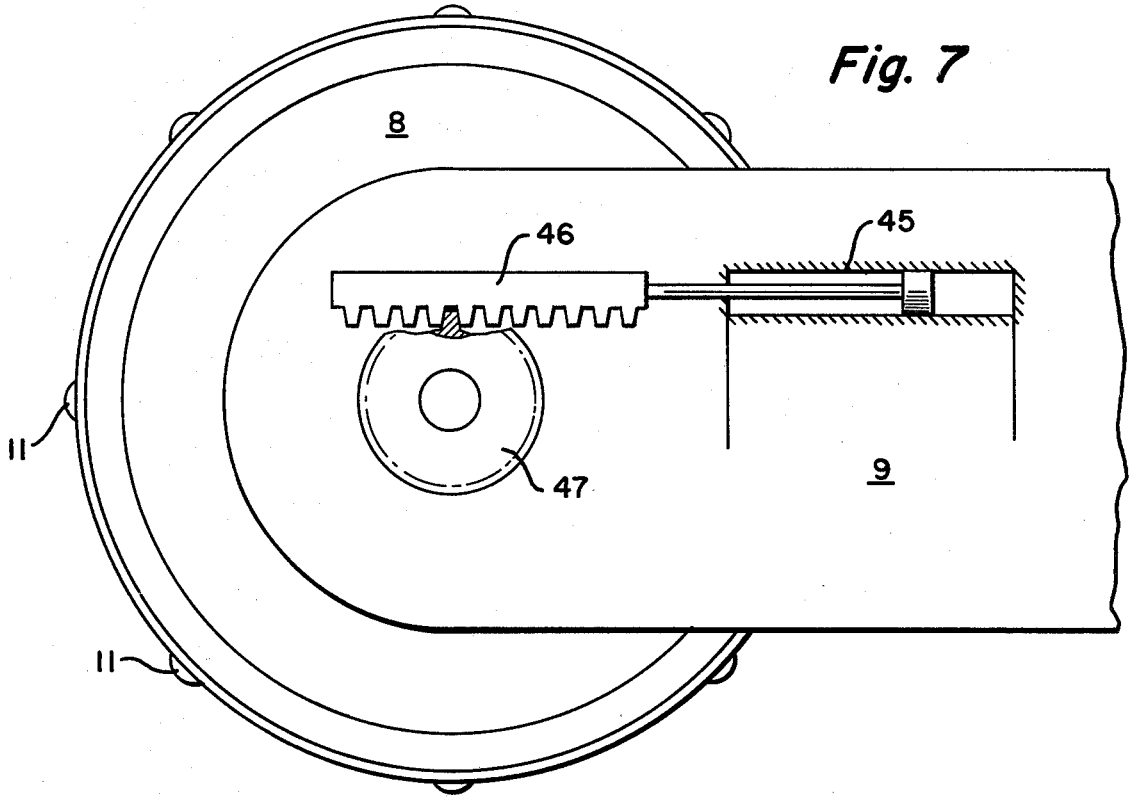
FIG. 7 is an enlarged diagrammatic view illustrating one embodiment of additional apparatus for controlling liquid discharged from a shearing drum in accordance with the present invention.
Figure 8:
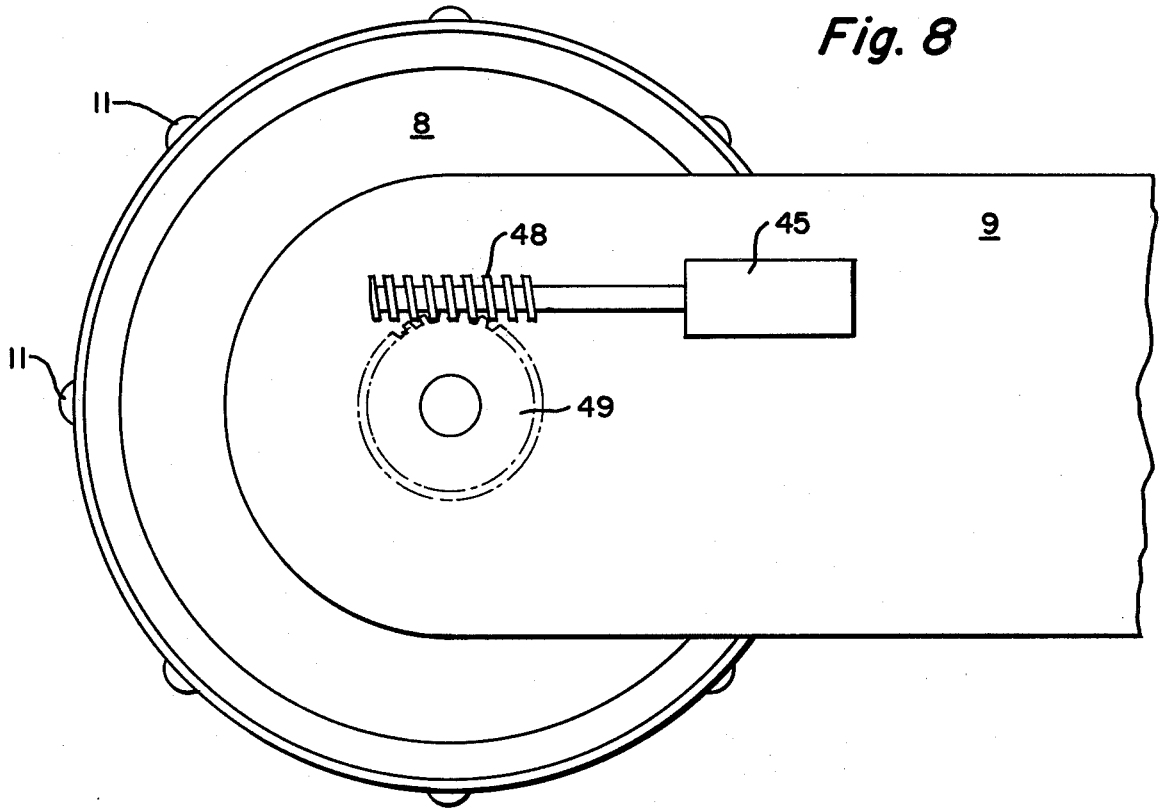
FIG. 8 is a view similar to FIG. 7 but illustrating a further embodiment of such apparatus.

FIG. 7 illustrates a still further aspect of the present invention wherein the shaft 40 or tube 16 is mounted for rotation about its longitudinal axis. A single recess 31 is then used to supply one or the other half of the periphery of the drum 8 with pressurized liquid which is supplied whenever the nozzles 11 are immediately adjacent the face 7. By employing this relationship of parts, the support arm 9 is provided with an adjusting drive 45 which, as shown in the embodiment of FIG. 7, comprises a double-acting piston and cylinder assembly having its rod end coupled to a toothed rack 46 to mesh with a gear 47 that is, in turn, coupled to tube 16 or shaft 40. Alternatively, if desired, as shown in FIG. 8, a rotary motor, e.g., hydraulic or electric, is used to rotate a worm 48 while meshing with a wormwheel 49 coupled with the tube 16 or shaft 40. The two forms of drives are used to adjust the position of the recess 31 as required and to correlate the position thereof with the position of the mine face 7.

Figure 9:
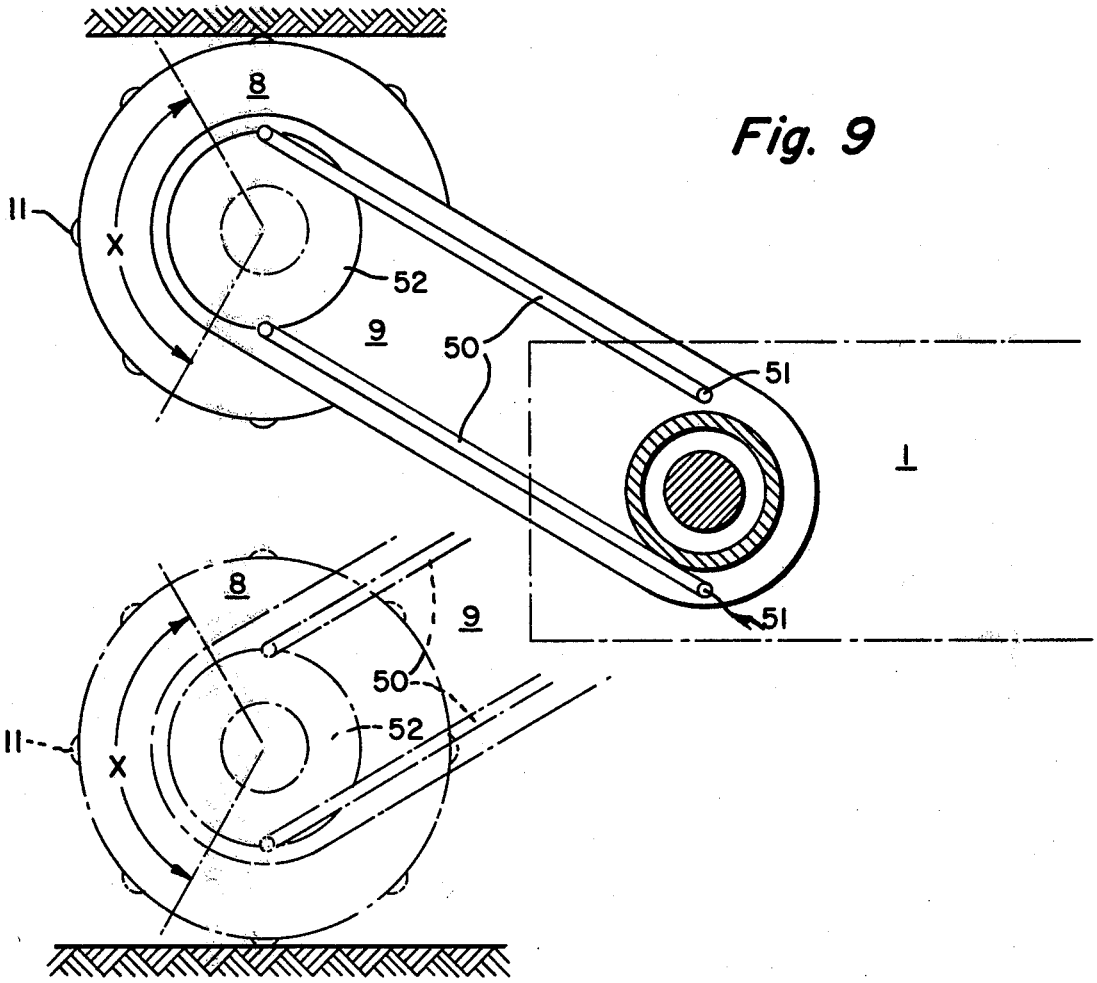
FIG. 9 is a view similar to FIGS. 7 and 8 but illustrating a still further embodiment of such apparatus.

In the embodiment of the invention shown in FIG. 9, two bars or chains 50 are arranged parallel to one another and employed to rotate tube 16 and, therefore, sleeve 17 or shaft 40 in a dependent relation upon the pivotal angle of arm 9. The two bars or chains 50 are secured by pivot pins 51 to the machinery unit while at their other ends, the bars or chains are connected to a disc 52 that is, in turn, joined to tube 16 or shaft 40. Because the bars or chains 50 extend parallel to one another and are connected to the machinery unit, the parts are arranged to form a parallel crank drive on the disc 52 and, therefore, on shaft 40, i.e., by sleeve 27. In this way, the supply region X of nozzles 11 is always brought into a position corresponding to the position of the mine face 7.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In a mining machine having drive means for propelling the mining machine along a course of travel of a mine face, the mining machine including a machinery unit, a pivotal support arm carrying a rotatably-driven shearing drum, the combination therewith of apparatus to discharge liquid from only an arcuate face segment of said shearing drum while directed toward a mine face, said apparatus including;

liquid discharge nozzle members circumferentially distributed about the periphery of said shearing drum, conduit members extending radially in said shearing drum to communicate with the circumferentially-spaced nozzle members, shaft means about which said shearing drum independently rotates, said shaft means having at least one internal opening to conduct liquid in a direction generally parallel to the rotational axis of the shearing drum, said shaft means including a valve having a valve recess substantially at the longitudinal center within the periphery of said shaft means for communication with the internal opening thereof, said valve recess extending about a peripheral surface of the shaft means through an angle selected to correspond to at least part of the arcuate face of the shearing drum while directed toward the working face of the mine, and means rotatable with said shearing drum in sealed communication with the valve of said shaft means to control the period while individual ones of said conduit members deliver liquid passed through said valve to said nozzle member.

2. The combination of claim 1 wherein said means rotatable with the shearing drum define conduit lines extending radially from an opening therein and sealed to said shaft means within a common plane perpendicular to the rotational axis of said shearing drum.

3. The combination according to claim 1 wherein said means rotatable with the shearing drum defines conduit lines extending radially within one of a plurality of axially-spaced planes each perendicular to the rotational axis of said shearing drum.

4. The combination according to claim 3 wherein said valve recess has a varying peripheral width in an axial direction along the shaft means to vary the period of communication with individual ones of said conduit lines.

5. The combination according to claim 1 wherein the valve of said shaft means includes two diametrically-opposite valve recesses within the periphery of said shaft means.

6. The combination according to claim 5 wherein said shaft means includes two discrete internal openings each communicating with only one of said opposite valve means.

7. The combination according to claim 1 further including mounting means to support said shaft means for rotary movement about the longitudinal axis thereof.

8. The combination according to claim 7 further including an adjusting drive means for rotating said shaft means.

9. The combination according to claim 1 further including a parallel crank drive including disc means drivingly connected to said shaft means, said disc means being disposed at the end of said shearing drum adjacent said pivotal support arm, spaced and generally parallel members engaging said disc means at diametrically-disposed pivot points, and pivot pin means to connect said parallel members to said machinery unit.

* * * * *